United States Patent [19]

Mitsuishi et al.

[11] Patent Number: 5,024,543

[45] Date of Patent: Jun. 18, 1991

[54] IMPACT DOT PRINT HEAD

[75] Inventors: Akio Mitsuishi; Takashi Takeuchi; Osamu Koshiishi, all of Suwa, Japan

[73] Assignee: Seiko Epson Corporation, Tokyo, Japan

[21] Appl. No.: 356,822

[22] Filed: May 24, 1989

[30] Foreign Application Priority Data

May 25, 1988 [JP] Japan ..... 63-129279
Jul. 18, 1988 [JP] Japan ..... 63-178578

[51] Int. Cl.[5] ..... B41J 2/27
[52] U.S. Cl. ..... 400/124; 101/93.05
[58] Field of Search ..... 400/124; 101/93.05

[56] References Cited

U.S. PATENT DOCUMENTS

| | | | |
|---|---|---|---|
| 4,214,836 | 7/1980 | Wang | 400/124 |
| 4,302,115 | 11/1981 | Yasunaga et al. | 400/124 |
| 4,396,304 | 8/1983 | Davenport et al. | 400/124 |
| 4,568,207 | 2/1986 | Hara et al. | 400/124 |
| 4,925,625 | 5/1990 | Shimosato et al. | 400/124 |

FOREIGN PATENT DOCUMENTS

| | | | |
|---|---|---|---|
| 2402267 | 9/1977 | France . | |
| 60-19544 | 7/1983 | Japan | 400/124 |
| 60-44356 | 8/1983 | Japan | 400/124 |
| 60-192650 | 3/1984 | Japan | 400/124 |
| 58-217374 | 3/1984 | Japan . | |
| 62-259870 | 5/1986 | Japan | 400/124 |
| 222759 | 10/1986 | Japan | 400/124 |
| 62-204958 | 2/1988 | Japan . | |

*Primary Examiner*—Edgar S. Burr
*Assistant Examiner*—John S. Hilten
*Attorney, Agent, or Firm*—Blum Kaplan

[57] ABSTRACT

An impact dot print head for printing without impact noise when returning to the non-printed position includes a base. An arm is mounted for movement between a non-print position and a print position. A print wire is mounted on the arm. A first device selectively drives the arm towards the print position by bias or magnetic force. A second device returns the arm to the non-print position and maintains the arm at that position without causing the arm to impact any member of the print head when returning to the print position. The second device uses balanced magnetic attraction or repulsion and/or bias forces to hold the arm out of contact with other parts of the printer other than at its point of mounting when at the non-print position.

12 Claims, 7 Drawing Sheets

IMPACT DOT PRINT HEAD

BACKGROUND OF THE INVENTION

The present invention relates to an impact dot print head, and in particular to an impact dot print head in which an electromagnetic force is used to cause the print wire to strike the platen.

Electromagnetic impact dot print heads are known in the art. One type of a conventional impact dot print head, as shown in FIG. 1, includes a core 63. A permanent magnet 62 is positioned within core 63 and an elastic arm 61 is supported on core 63 and supports a drive print wire 60. A magnetic member 65 is supported on elastic arm 61 and is attracted by permanent magnet 62, acting through the core. A conductive coil 64 is mounted about core 63 and and cancel a magnetic force produced by the permanent magnet when current flows therethrough.

Magnetic member 65 is attracted to core 63 due to the magnetic force of permanent magnet 62 thus deflecting elastic arm 61 toward core 63. This displaces print wire 60 in a direction away from the platen. To print, current is caused to flow through conductive coil 64 to provide a magnetic field which cancels the magnetic attraction between core 63 and magnetic member 65 thereby causing elastic arm 61 to drive print wire 60 towards the platen due to the restoring force of elastic arm 61.

A second conventional impact dot print head, shown in FIG. 2, includes a core 72 having an arm 68 pivotable mounted thereon. Arm 68 supports a print wire 66 at one end. A magnetic member 74 is mounted on arm 68. A conductive coil 70 is mounted on core 72 and provides a magnetic current when current flows therethrough. When in a non-printing position arm 68 contacts the inner surface of print head case 67, and is preferably held in that position by a biasing means (not shown).

Printing occurs by applying a current to solenoid 70. A magnetic field is formed attracting magnetic member 74 towards core 72 driving print wire 66 towards the platen.

Both of these conventional print heads have been satisfactory. However, they suffer from the disadvantage that they both produce a large amount of noise during operation. In the print head of FIG. 1, magnetic member 65 contacts core 63 in the non-printing position, similarly in the conventional print apparatus of FIG. 2 arm 68 contacts case 67 in the non-printing position. Accordingly, an impact noise occurs after each print stroke causing a large amount of noise during a series of successive print operations. To solve such problems, elements for absorbing the impact are provided in a position where the movable member and the non-movable member contact each other. However, these impact absorbing members are easily deformed so that the initial or preprinting position becomes changed over time, deteriorating the print quality. Furthermore, because the impact of the absorbing members can not fundamentally solve the problem, the noise generation can not be effectively controlled.

Accordingly, it is desired to provide an impact dot print head which removes the noise generated when the print wire returns to the non-print position without utilizing a deformable impact absorbing member.

SUMMARY OF THE INVENTION

Generally speaking, in accordance with the present invention, an impact dot print head includes an arm having a print wire member thereon. A first magnet selectively provides a magnetic force causing the arm to drive the print wire towards the platen for printing. A second magnet maintains the arm in a non-printing position so that the arm does not come in contact with the remainder of the printer when the first magnetic is not activated.

The first magnet may be a coil wound about the second magnet for cancelling the magnetic forces produced by the second magnet.

Accordingly, it is an object of the present invention to provide an improved impact dot print head.

Another object of this invention is to provide an impact dot print head in which the moving members come only in contact with the platen.

Yet another object of the invention is to provide an impact dot print head which operates with less noise during printing.

A further object of the invention is to provide an impact dot print head which consumes less power during operation.

Yet another object of the invention is to provide an impact dot print head which is capable of high speed printing.

Still other objects and advantages of the invention will in part be in obvious and will in part be apparent from the specification and drawings.

The invention accordingly comprises the features of construction, the combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
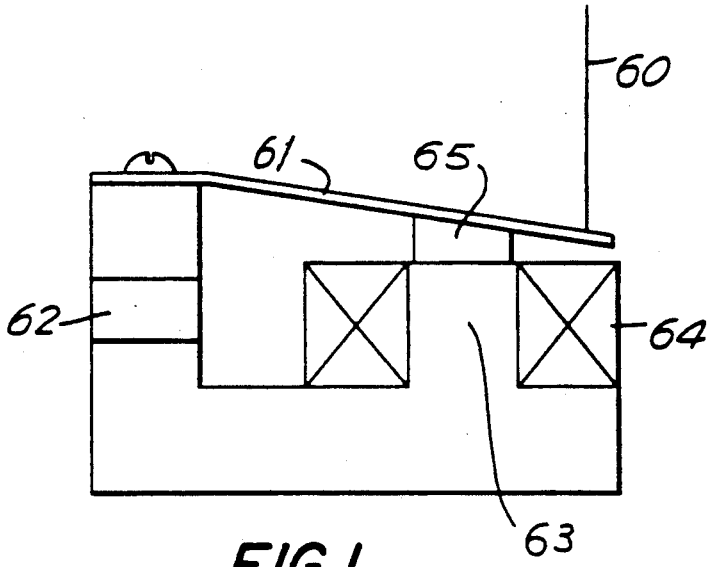
FIG. 1 PRIOR ART
FIG. 1 is a sectional view of a first type of impact dot print head constructed in accordance with the prior art.
Figure 2:
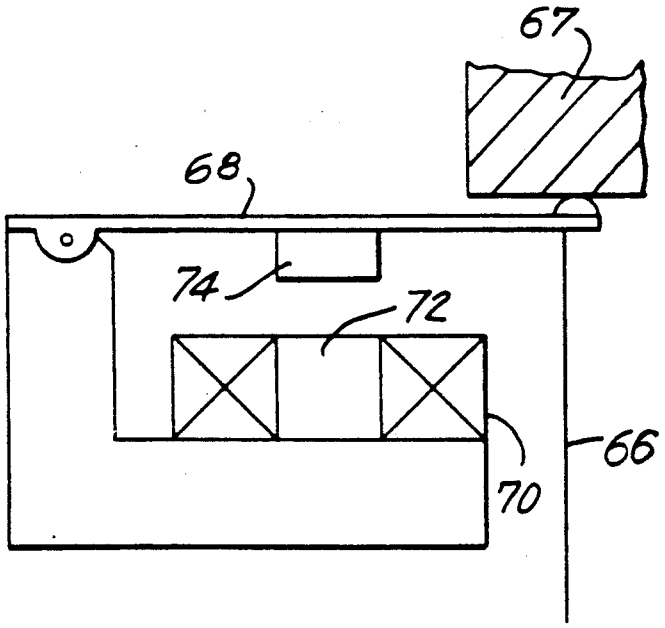
FIG. 2 PRIOR ART
FIG. 2 is a sectional view of a second type of impact dot print head constructed in accordance with the prior art.
Figure 3:
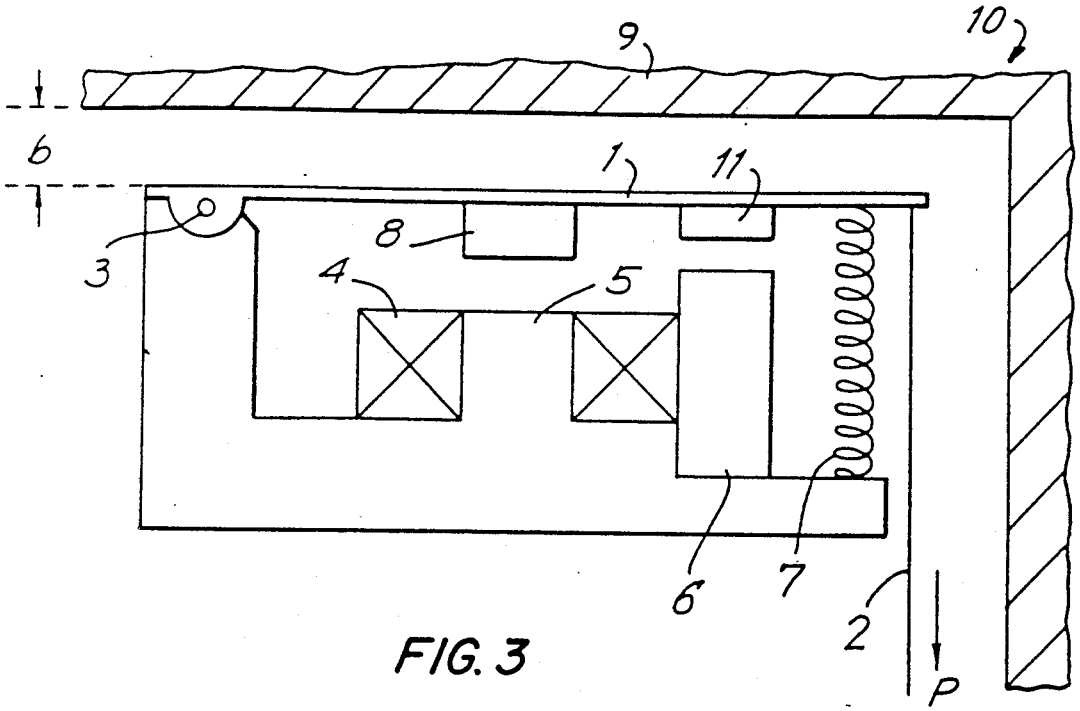
FIG. 3 is a sectional view of an impact dot print head constructed in accordance with the invention.

Reference is first made to FIG. 3 where an impact dot print head, generally indicated at 10, constructed in accordance with a first embodiment of the invention is provided.

Impact dot print head 10 includes a casing 9 within which is supported a core 5. A pivot axis 3 extends through core 5. An arm 1 is rotatably mounted about pivot axis 3 at its one end and supports a print wire 2 at its other end so that arm 1 pivots around pivot axes 3. A compressible spring 7 is affixed between core 5 and arm 1 to bias arm 1 away from core 5 into an initial non-printing position. A magnetic member 8 is affixed on arm 1. A conductive coil 4 is wound about core 5 and provides a magnetic force when current flows therethrough to attract magnetic member 8. A second magnetic member 11 is mounted on arm 1. A magnet 6 is mounted on core 5 and provides a magnetic force attracting magnetic member 11 towards magnet 6.

The attractive force of magnet 6 applied to magnetic member 11 equals that applied by spring 7 to arm 1 when arm 1 is in the initial or non-printing position. When current flows through coil 4, a magnetic force is applied attracting magnetic member 8 and overcoming the spring force of spring 7, thus moving arm 1 and driving print wire 2 in the direction of arrow P. Print wire 2 strikes an ink ribbon against a sheet of paper resting on a platen, forming dots on the paper. The current flowing through coil 4 is then stopped so that spring 7 applies a restoring force to arm 1 in a direction away from the platen to restore arm 1 to the initial out-of-contact position.

When arm 1 returns to the initial position magnet 6 acts as a brake reducing the speed of arm 1 as it returns to the initial position. This reduces the amount by which arm 1 overshoots the initial position upon its return due to the reduced speed of arm 1 as it returns to the initial position. The overshoot distance is quite small and arm 1 returns the position at which the restoring force of spring 7 balances the attraction of magnet 6. Because the amount by which arm 1 overshoots the initial position is relatively small, arm 1 returns to the initial position without contacting the inner surface of case 9. Accordingly, the only noise generated by print head apparatus 10 is the noise of print wire 2 being driven against the platen.

It is the compression of spring 7 cooperating with the attractive force of magnet 6 which returns arm 1 to the initial position. However, because arm 1 does not contact any other portion of impact dot print head 10, arm 1 freely oscillates about axis 3 prior to returning to the initial position. A current may be applied to coil 4 during the occurrence of a downward oscillation so that the attractive force of coil 4 is added to the downward kinetic energy of moving arm 1. Accordingly, the speed at which print wire 2 is driven is increased and print wire 2 can be driven utilizing less electrical energy when compared to moving print wire 2 from the initial pre-print position.

Figure 4:
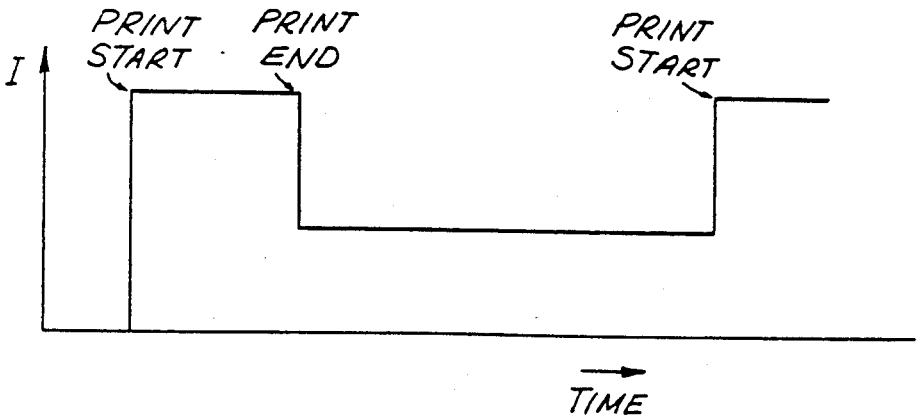
FIG. 4 is a timing graph for an impact dot print head constructed in accordance with the invention.

In this example, the magnetic force necessary for maintaining the initial position was attained by the use or additional magnet 6. However, the same effect can be obtained by eliminating magnet 6 and supplying a current to coil 4, as shown FIG. 4. The current is maintained at a predetermined level between successive prints and the current is increased during each print. At this predetermined level coil 4 provides an attractive force equal to the restoration force of spring 7 at the initial position.

Figure 5:
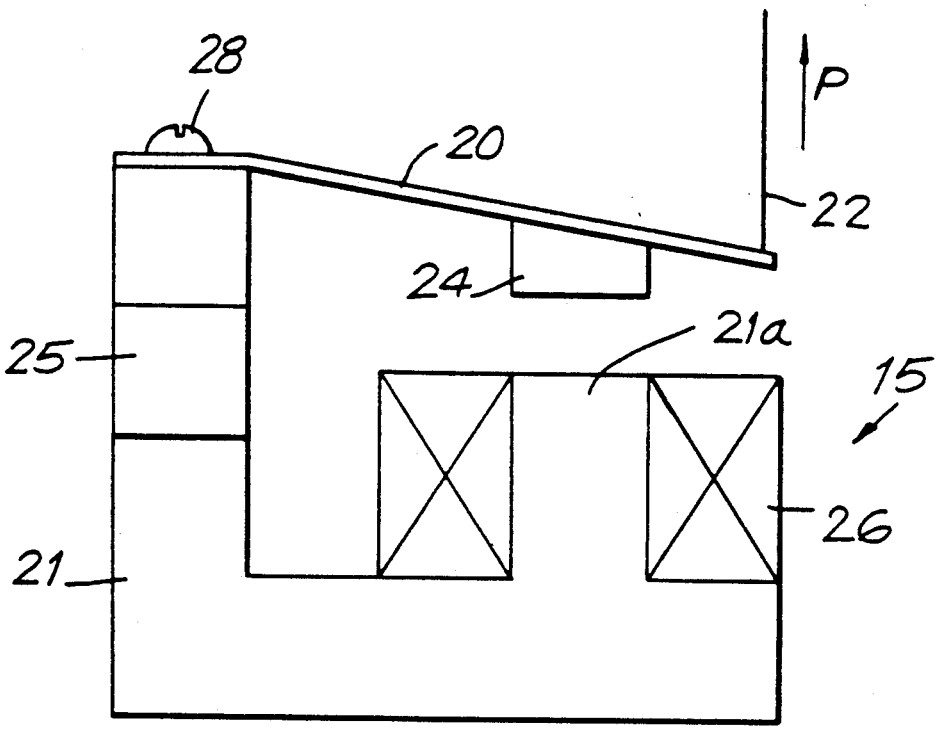
FIG. 5 is a sectional view of an impact dot print head constructed in accordance with a second embodiment of the invention.

Reference is now made FIG. 5 wherein an impact dot print head, generally indicated at 15, constructed in accordance with a second embodiment of the invention is provided. An arm 20 is mounted on a static member core 21 by a screw 28. Arm 20 is a spring member being attached at its one end to core 21 and supporting a print wire 22 at its other end. A magnetic member 24 is mounted on arm 20 in facing relationship pole portion 21*a* of core 21. A permanent magnet 25 is mounted in core 21. Magnetic pole portion 21*a* extends from core 21 and is surrounded by magnetic coil 26. The distance between magnetic pole portion 21*a* and arm 20 is maintained so that they do not contact each other when arm 20 is in the initial, non-printing position.

Permanent magnet 25 provides an attractive force for maintaining arm 20 in the initial position. To print, print signals are input so that current flows through coil 26 in a direction which applies a magnetic force to magnetic member 24 overcoming the attractive force provided by permanent magnet 25. As a result, the potential energy of arm 20 is released driving print wire 22 in the direction of arrow P to the platen. Once arm 20 causes print wire 22 to contact the platen, the current flow through coil 26 is stopped and the attractive force is provided by permanent magnet 25 to attract arm 20 towards the initial position. Arm 20 overshoots the initial position but magnetic member 24 does not contact magnetic pole portion 21*a* because the distance therebetween is initially provided at a sufficient enough dimension to prevent contact. The attractive force of permanent magnet 25 balances the spring force of arm 20 to maintain arm 20 in the initial position as shown in FIG. 5.

As in impact dot print head 10, arm 20 oscillates freely about a pivot point when returned to the initial position. When arm 20 is oscillating in the direction of arrow P, less electrical energy is needed to counterbalance the magnetic attraction of permanent magnet 25 when driving print wire 22 towards the platen. Accordingly, the consumption of electricity may be reduced by timing a print signal to the upper oscillation of arm 20 during successive prints. Moreover, the distance between magnetic pole position 21*a* and magnetic member 24 is maintained at a large enough distance to prevent these members from contacting each other during the oscillations of arm 20 when arm 20 is returned to the initial position. However, if the magnetic power of permanent magnet 25 is relatively counterbalanced by providing current through coil 26 when arm 20 is returned to the initial position, the amount of overshooting by arm 20 can be reduced.

Figure 6:
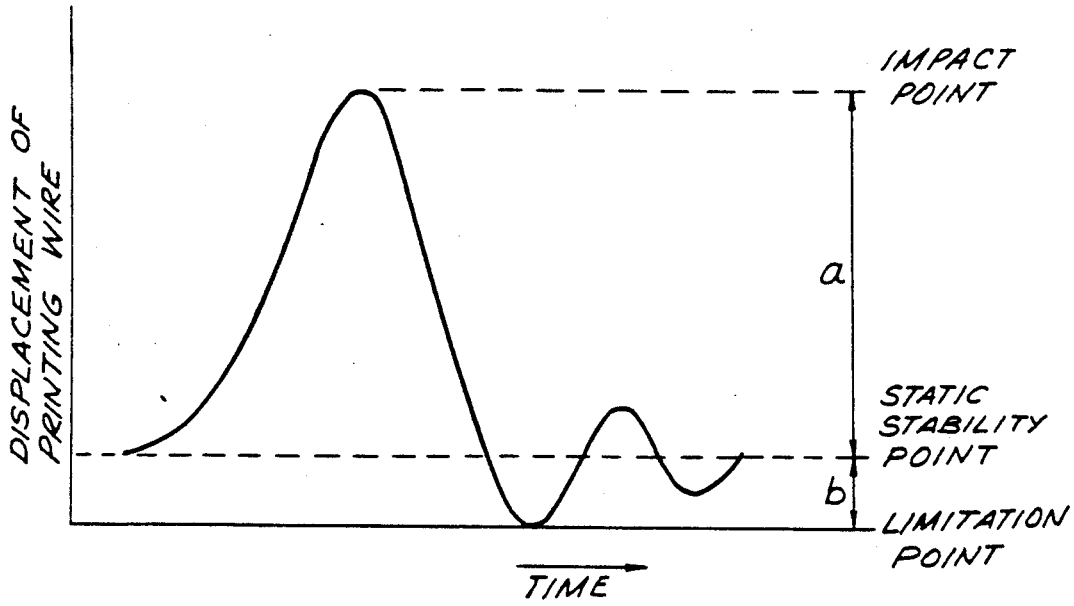
FIG. 6 is a graphical representation of the displacement of the print wire over time in accordance with the invention.
Figure 7:
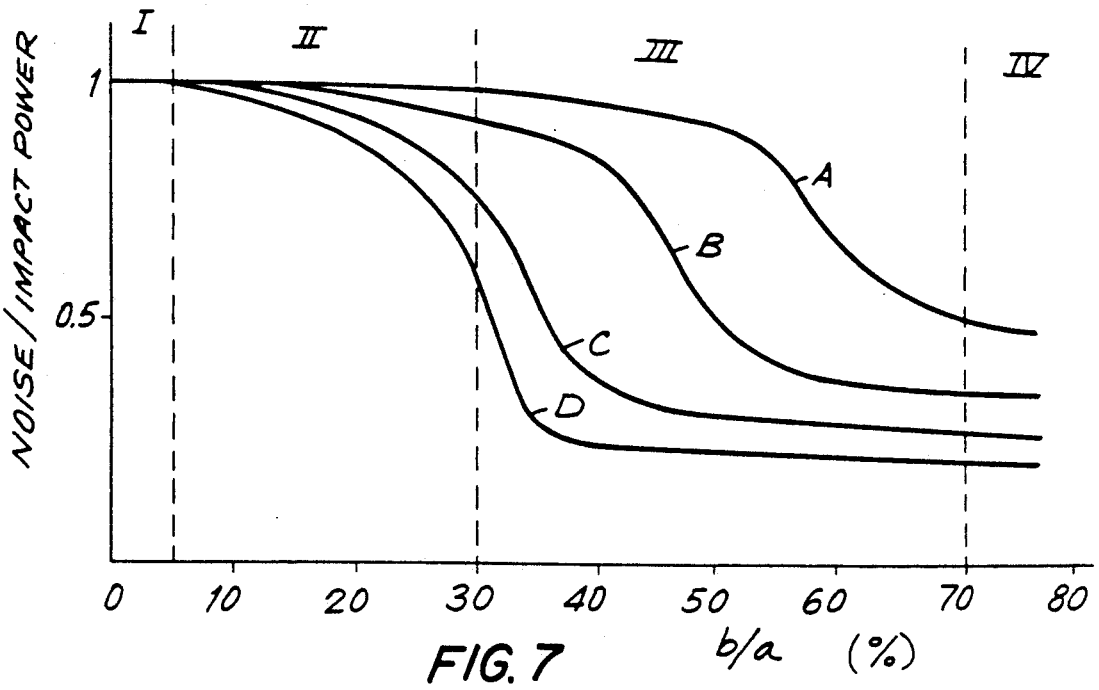
FIG. 7 is a graphical representation of the relationship between the noise of an impact print head as it varies with the placement of the arm in accordance with the invention.

Reference is now made to FIGS. 6 and 7 in which the relative impact power between print heads constructed in accordance with the invention under different displacement conditions is provided. Reference is again made to impact dot print head 10 in which impact dot print head is operated at four impact power levels so that the impact power of print head A is greater than the impact power of print head B which is in turn greater than the impact power of print head C which is in turn greater than the impact power of print head D. The distance between the initial position of arm 1 and casing 9 is b. The distance between the initial position and the print wire impact point is a distance a (FIG. 6).

In FIG. 7 the ratio of b/a is graphically compared to the ratio of the printing noise to impact power in a condition so that ratio of noise/impact power is 1 when arm 1 contacts case 9 of impact dot print head 10. When small impact power is utilized such as in print head D, the noise is relatively reduced when the ratio b/a becomes at least 5%. In particular, the condition in which arm 1 almost contacts case 9. When the ratio of b/a is greater than 35%, arm 1 is more distanced from case 9 and the only noise results from the sound of print wire 2 striking paper. Looking at print head A, which has a large impact power, the noise does not become substantially reduced until the ratio of b/a is substantially 30% or greater. But levels in which the ratio b/a is roughly 70% the only noise resulting from operation of impact dot print head 10 is the sound of print wire 2 impacting paper.

In summary, when impact dot print head 10 is operated within the zone I, the ratio b/a is less than 5%, and there is no observable noise reduction. However, when operating impact dot print head 10 within zone II, the ratio b/a is between 5% and 30%, and the noise occurring during operation does becomes reduced. When operating impact dot print head 10 in zone III, where the ratio b/a is between 30% and 70%, the noise generated during operation is greatly reduced. When impact dot print head 10 is operated in zone IV where the ratio b/a is greater than 70, the noise is limited to a substantially constant value independent of the impact power of the print head.

Figure 8:
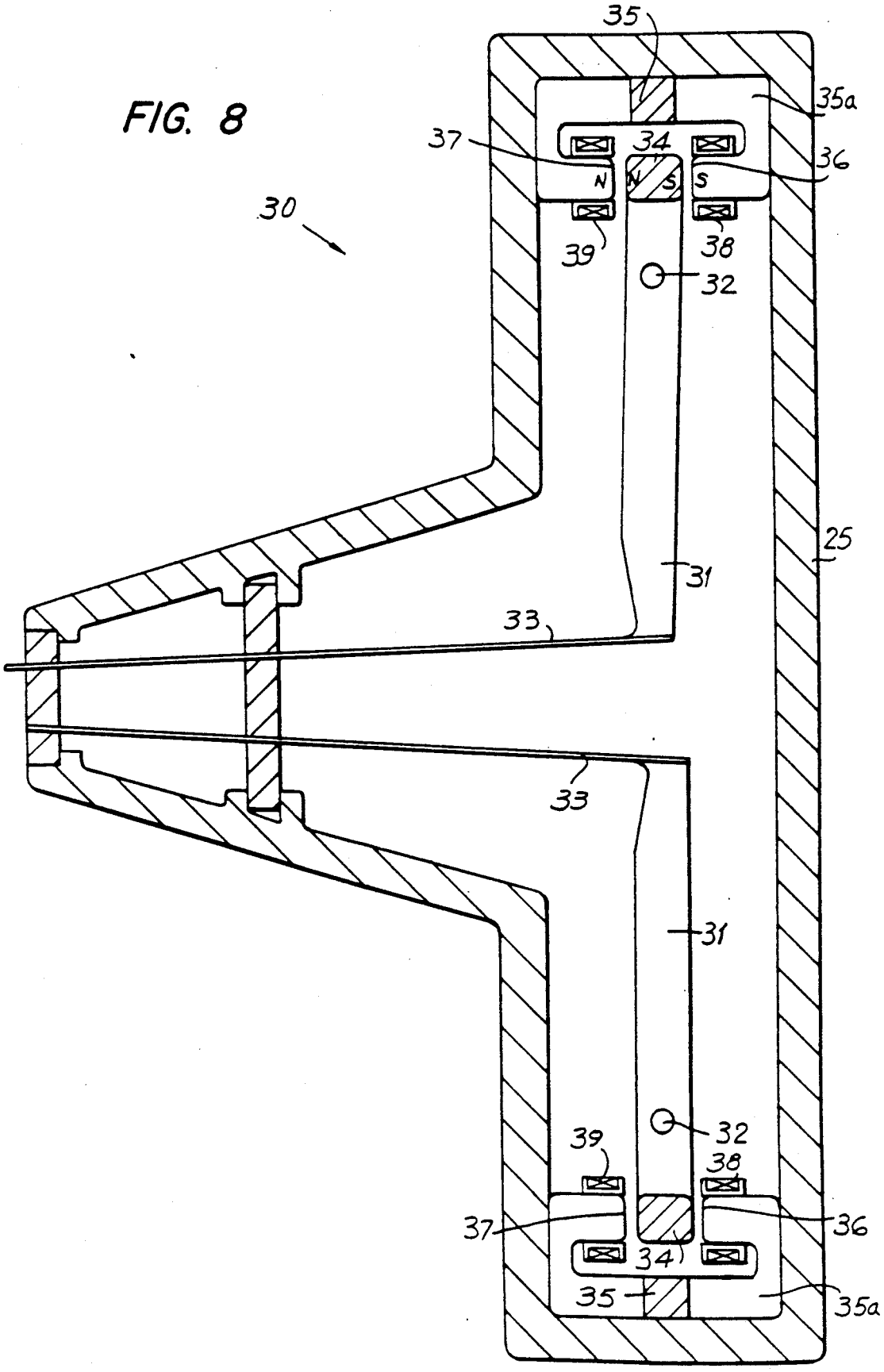
FIG. 8 is a sectional view of an impact dot print head constructed in accordance with a third embodiment of the invention.

Reference is now made FIG. 8 wherein a impact dot print head, generally indicated at 30, constructed in accordance with a third embodiment of the invention is provided. The lower half of impact dot print head 30 is in the initial or non-printing position while the upper half of impact dot print head 30 is in the printing position. Each half is a mirror image of the other and accordingly only one half will be described as illustrating both halves.

Impact dot print head 30 includes a case 25 having an axis 32 supported therein. A lever 31 is mounted on axis 32 by a bearing so that lever 31 can be rotated about axis 32. A print wire 33 is affixed at one end of lever 31. A permanent magnet 34 having an S-pole and N-pole in the horizontal direction is mounted at the other end of lever 31.

A yoke 35*a* is positioned in an area near permanent magnet 34 and has yoke ends 36, 37 positioned so that magnet 34 is displaced between yoke ends 36, 37. A permanent magnet 35 contained within yoke 35*a* magnetizes yoke ends 36, 37 to have poles identical to the region of permanent magnet 34 which faces that respective yoke end 36 and 37. Therefore, a magnetic repelling force is provided by yoke ends 36, 37 acting on permanent magnet 34 holding permanent magnet 34 in the initial position at a position where magnetic power is balanced. A conducting coil 39 is wound about yoke end 37 to cancel the magnetic repulsion of yoke end 37 when a current flows through conducting coil 39. Similarly, a conducting coil 38 is wound about yoke end 36 to cancel the magnetic repulsion of yoke end 36 when activated.

To effect printing a current is supplied through conducting coil 38 to cancel the repulsive force of yoke end 36 acting on permanent magnet 34. The repulsive magnetic force applied by yoke end 37 on permanent magnet 34 causes lever 31 to rotate about axis 32 causing print wire 33 to extend to strike the paper. To return print wire 33 to the initial position current is sent through conductive coil 39 to provide an magnetic field which cancels the effect of yoke end 37 acting on permanent magnet 34. The current flowing through conductive coil 38 has been stopped so that the repulsive magnetic force of yoke end 36 acting on permanent magnet 34 cause lever 31 to rotate about axis 32 returning print wire 33 to the initial condition. The current flow through coil 39 is stopped so the repulsive force of yoke 37 also acts on permanent 34 to return lever 31 to the initial position.

In the example of FIG. 8 the right side of the permanent magnet 34 is the S-pole and the left portion of permanent magnet 34 is the N-pole. However, the position of the poles may be switched as a resilient force may be generated merely be matching the poles with the polarity of the yoke ends. Additionally, the same effect would be obtained if the coil 38, 39 were wound or conducted in a different direction.

Figure 9:
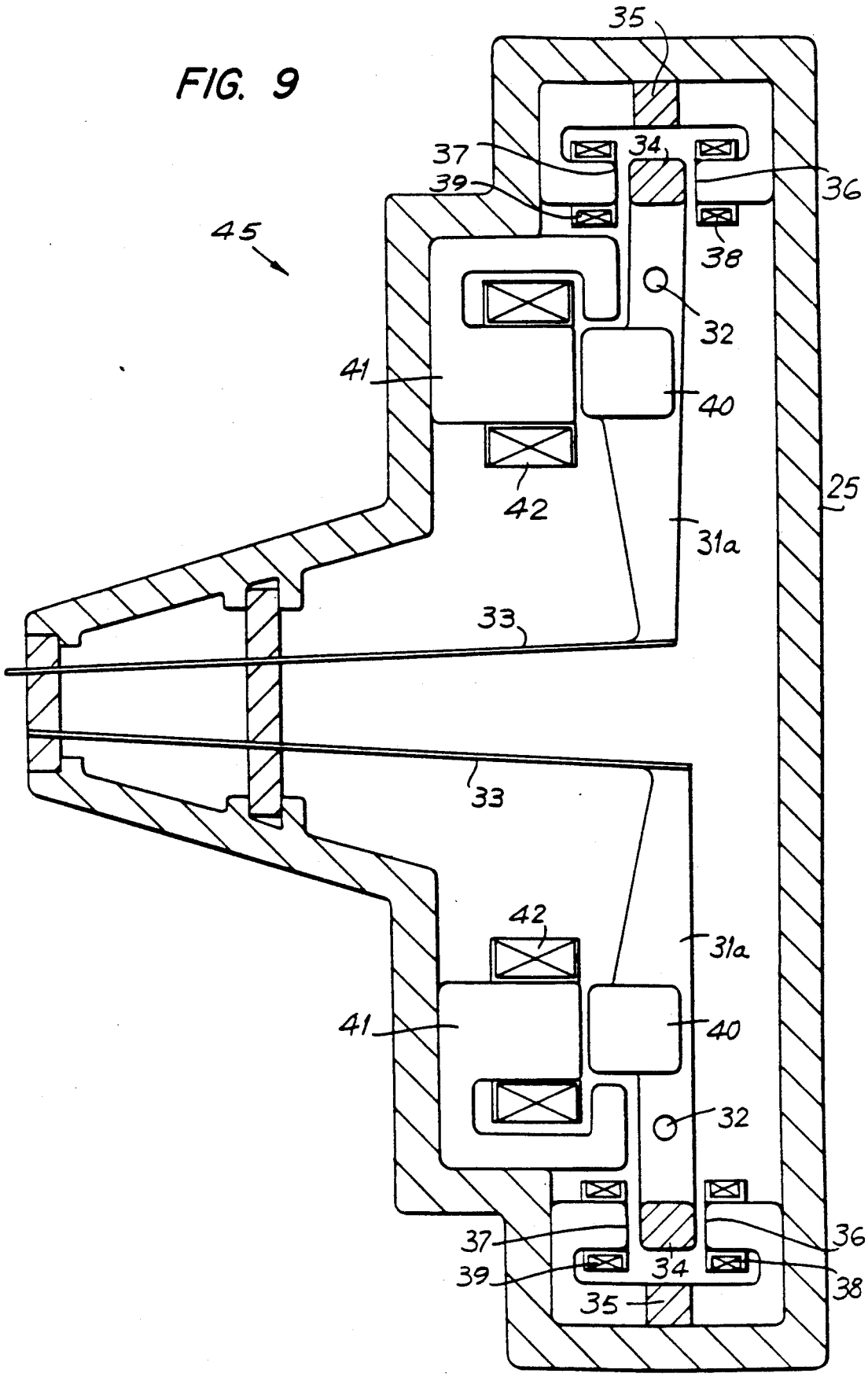
FIG. 9 is a sectional view of an impact dot print head constructed in accordance with the present invention.

Reference is now made to FIG. 9 wherein an impact dot print head, generally indicated at 45, constructed in accordance with the invention is provided. Like numerals are utilized to indicate like structure, a substantial difference between impact dot print head 45 and dot print head 30 being the use of a plunger, yoke and coil arrangement.

A lever 31*a* is provided with a plunger 40 positioned therein. A yoke 41 is positioned in facing relationship with plunger 40. A conducting coil 42 is wound about yoke 41. By providing a current through conducting coil 42 an attractive magnetic force is provided between yoke 41 and plunger 40 causing lever 31*a* to rotate about axis 32. Simultaneously the repulsive force of yoke end 37 is operating on permanent magnet 34 to further drive lever 31*a*, and the repulsive force of yoke end 36 is cancelled by providing a current through coil 38. To return lever 31*a* to the initial position, the current flow through coil 42 is stopped along with the current flow through coil 38, a current flows through coil 39 as discussed above, long enough to retract the print wire 33 but is removed in time to permit return to the rest position. Because the energy and magnetic forces used for moving lever 31*a* are stronger in impact dot print head 45, higher speed driving may be obtained as compared with impact dot print head 30.

Figure 10:
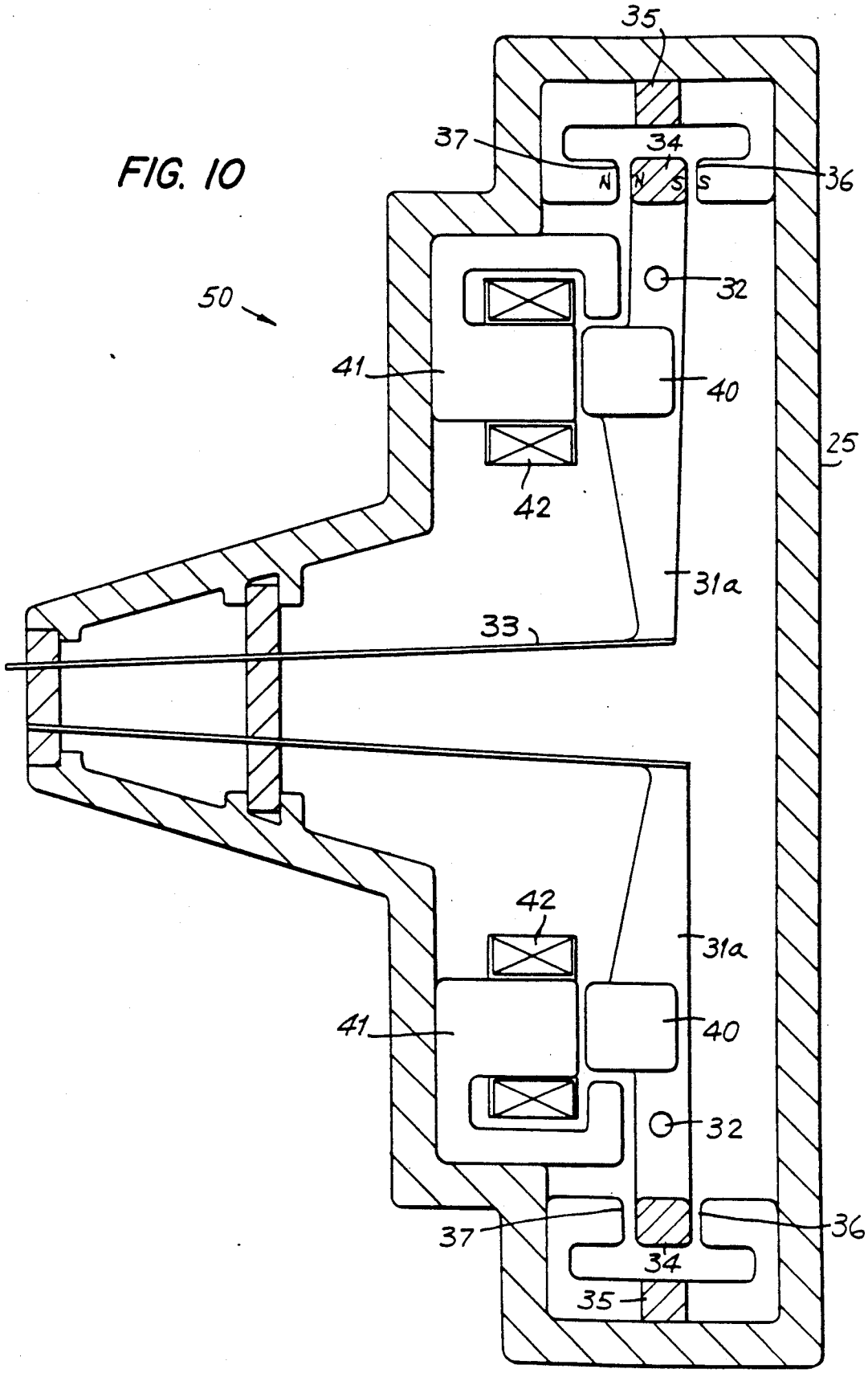
FIG. 10 is a sectional view of an impact dot print head constructed in accordance with a fifth embodiment of the present invention.

Reference is now made to FIG. 10 wherein an impact dot printer, indicated at 50, constructed in accordance with a fifth embodiment of the invention is provided. Impact dot printer 50 is similar to impact dot print head 45, and like numerals are used to indicate like structure. The substantial difference between impact dot printer 50 and impact dot printer 45 is the removal of coils about the yoke ends for controlling the permanent magnet.

To cause printing in impact dot printer 50, current is provided through conductive coil 42. This provides an attractive magnetic force between plunger 40 and yoke 41 causing lever 31*a* to rotate about axis 32 in a counterclockwise direction and cancel a magnetic force produced by the permanent magnet. Print wire 33 extends without case 25 to strike paper or ink ribbon, thereby printing. To return print wire 33 to the initial position the flow of current through conductive coil 42 is stopped and the repulsive forces provided by yoke ends 36, 37 act on the permanent magnet 34, thus providing an impact dot print head which relies on polarity for removing noise during the print operation which operates and is constructed at a lower cost. Again, any combination of polarity may be used as discussed in greater detail above.

It will thus be seen that the objects set forth above, among those made apparent from the preceding description are efficiently attained and since certain changes may be made in the above constructions without departing from the spirit and scope of the invention, it is intended that all matter contained in the above description or shown in the accompanying drawings shall be interpreted as illustrative and not in the limiting sense.

It is also to be understood that the following claims are intended to cover all of the generic and specific features of the invention herein described and all statement of the scope of the invention which, as a matter of language may be said to fall therebetween.

What is claimed is:

1. An impact dot print head comprising an arm; means for pivotably supporting the arm for movement between a non-print position and a print position, a print wire mounted on the arm, first means for driving the arm towards the print position, said first means being a first magnet means and second means for driving the arm towards the non-print position and maintaining the arm in the non-print position without causing the arm to impact the remainder of the print head when returning to the non-print position, the second means being a second magnet means for holding the arm at the non-print position without mechanical contact by applying a magnetic force in the direction of wire movement towards the print position.

2. The impact dot print head of claim 1, wherein said first means includes the first magnet means for selectively driving the arm toward the print position and the second means maintains the arm in the non-printing position only when the first magnet means has not been actuated.

3. The impact dot print head of claim 2, wherein the first magnet means provides an attractive force on the arm.

4. The impact dot print head of claim 3, wherein the second magnet means provides balanced repelling force on opposed sides of the arm at the non-print position.

5. The impact dot print head of claim 3, wherein the second magnet means provides balanced repulsive forces on opposed sides of the arm at the non-print position.

6. The impact dot print head of claim 1, wherein said arm oscillates freely about the non-print position when returning to the non-print position and the first means is adapted to selectively drive the arm towards the print position when the arm oscillates towards the print position.

7. The impact dot print head of claim 1, wherein the second magnet means provides an attractive force acting on said arm to maintain the arm in a non-print position and the first means includes the first magnet means for providing a magnetic force cancelling the attractive force of the second magnet means to drive the arm towards the print position.

8. The impact dot print head of claim 1, wherein said means for pivotably supporting the arm is a bearing, the arm rotating about the bearing, and said second means includes a first permanent magnet means affixed at one end of the arm, yoke means having a first yoke end and a second yoke end and having a second permanent magnet means embedded therein such that each yoke end is polarized, the first permanent magnet means being disposed between said yoke ends and having a polarity the same as the polarity of the yoke end it faces, whereby each yoke end applies a repulsive force on said first permanent magnet means.

9. The impact dot print head of claim 8, wherein said first means includes a first conductive coil wrapped about the first yoke end and a second conductive coil wrapped about the second yoke end and means for selectively alternatively applying a current to said first and second conductive coils to provide a magnetic force for selectively alternatively cancelling the repulsive force of each respective yoke end to displace said arm between the non-print and print positions.

10. The impact dot print head of claim 9, wherein said first means further comprises a second yoke having a third conductive coil wound about said second yoke and a plunger mounted on said arm, the conductive coil applying an attractive force to said plunger to drive the arm towards the print position.

11. The impact dot print head of claim 8, wherein said first means comprises a second yoke having a third conductive coil wound about said second yoke and a plunger mounted on said arm, the conductive coil applying an attractive force to said plunger to drive the arm towards the print position.

12. The impact dot print head of claim 1, wherein said first means includes a plunger mounted on said arm, a yoke in facing relationship with said plunger and a conductive coil mounted about said yoke so that when current is selectively applied to said conductive coil an attractive force is applied upon said yoke driving the arm toward the print position.

* * * * *